US010844592B2

(12) United States Patent
Jimenez

(10) Patent No.: US 10,844,592 B2
(45) Date of Patent: Nov. 24, 2020

(54) MODULAR HOME SKIRTING SYSTEM WITH GROUND COVER STRIPS

(71) Applicant: Jose A. Jimenez, Salina, KS (US)

(72) Inventor: Jose A. Jimenez, Salina, KS (US)

( * ) Notice: Subject to any disclaimer, the term of this patent is extended or adjusted under 35 U.S.C. 154(b) by 0 days.

(21) Appl. No.: 16/366,842

(22) Filed: Mar. 27, 2019

(65) Prior Publication Data

US 2020/0277778 A1 Sep. 3, 2020

Related U.S. Application Data

(60) Provisional application No. 62/812,956, filed on Mar. 1, 2019.

(51) Int. Cl.
*E04B 1/343* (2006.01)
*E04H 17/06* (2006.01)

(52) U.S. Cl.
CPC ..... *E04B 1/34342* (2013.01); *E04H 17/063* (2013.01)

(58) Field of Classification Search
CPC ..... E04B 1/34342; E04H 17/063
See application file for complete search history.

(56) References Cited

U.S. PATENT DOCUMENTS 1,931,602 A 10/1933 Colman
2,949,698 A 8/1960 Downey et al.
3,106,411 A 10/1963 Holmes
3,571,998 A * 3/1971 Iacona ..... E04B 1/34342 52/478
3,704,004 A 11/1972 Carter, Jr.
3,713,624 A 1/1973 Niemann
3,727,347 A 4/1973 Barnes
3,775,917 A 12/1973 Struben
3,803,781 A * 4/1974 Struben ..... E04B 1/34342 52/149
3,832,813 A * 9/1974 Hindman ..... E04B 1/34342 52/169.12
3,945,747 A * 3/1976 Cruz ..... E01F 15/025 404/7
RE28,987 E * 10/1976 Iacona ..... E04B 1/34342 52/478
4,214,412 A 7/1980 Barylski
4,478,391 A 10/1984 Kovach
4,595,175 A 6/1986 Kauffman et al.
(Continued)

*Primary Examiner* — Rodney Mintz
(74) *Attorney, Agent, or Firm* — Jeffrey L. Thompson; Thompson Law, P.A.

(57) ABSTRACT

A ground cover strip is provided for use with a modular home skirting system to provide ground cover for protecting the skirting system during grounds maintenance and for suppressing vegetation. The ground cover strip includes flexible straight and corner pieces laid end-to-end on the ground surface around a perimeter of the modular home. The ground cover strip has a bottom, an outer edge, an inner edge, and a top between the outer and inner edges. The top has an open channel formed therein which faces upwardly and receives a base of a ground channel member. The top also has an outer portion that slopes downwardly from the open channel to the outer edge. Anchoring spikes are driven through the base of the ground channel member and the ground cover strip and into the ground to anchor the ground cover strip and the ground channel member to the ground.

16 Claims, 4 Drawing Sheets

(56) References Cited

U.S. PATENT DOCUMENTS

| | | | | |
|---|---|---|---|---|
| 4,805,361 | A * | 2/1989 | Mason | E04B 1/34342 52/169.12 |
| 4,831,776 | A | 5/1989 | Fritch | |
| 4,996,807 | A | 3/1991 | Walgamuth | |
| 5,396,731 | A | 3/1995 | Byrne | |
| 5,660,374 | A * | 8/1997 | Dayberry | E04H 17/063 256/1 |
| 5,669,187 | A * | 9/1997 | Bushong | E04B 1/72 52/101 |
| 6,076,327 | A | 6/2000 | Hendrickson | |
| 6,527,255 | B2 | 3/2003 | O'Berry et al. | |
| 7,685,781 | B1 | 3/2010 | Hatch | |
| 8,215,056 | B2 | 7/2012 | Frederick | |
| 10,378,202 | B1 * | 8/2019 | Stanfill | E04B 1/34342 |
| 2005/0252105 | A1 * | 11/2005 | Linse | E02D 27/01 52/169.9 |
| 2005/0252106 | A1 * | 11/2005 | Linse | E04H 9/021 52/169.9 |
| 2005/0252107 | A1 * | 11/2005 | Linse | E02D 27/01 52/169.9 |
| 2006/0130399 | A1 | 6/2006 | McDonald | |
| 2009/0188176 | A1 * | 7/2009 | Watson | E02D 29/10 52/102 |
| 2015/0007507 | A1 | 1/2015 | Nepa et al. | |
| 2015/0021531 | A1 | 1/2015 | Raab | |
| 2015/0218793 | A1 * | 8/2015 | Stanfill | E04B 1/34342 52/169.12 |
| 2017/0191286 | A1 * | 7/2017 | Rudolph | E04H 17/063 |
| 2018/0148950 | A1 * | 5/2018 | Hays | E04H 17/063 |
| 2020/0157796 | A1 * | 5/2020 | Reynolds | E04F 13/0803 |

* cited by examiner

Fig. 1
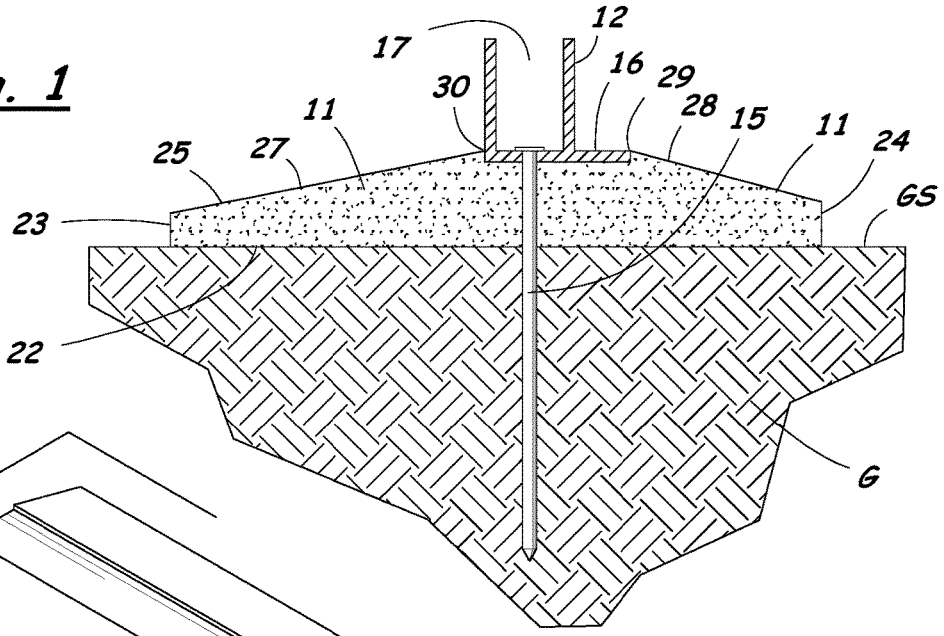
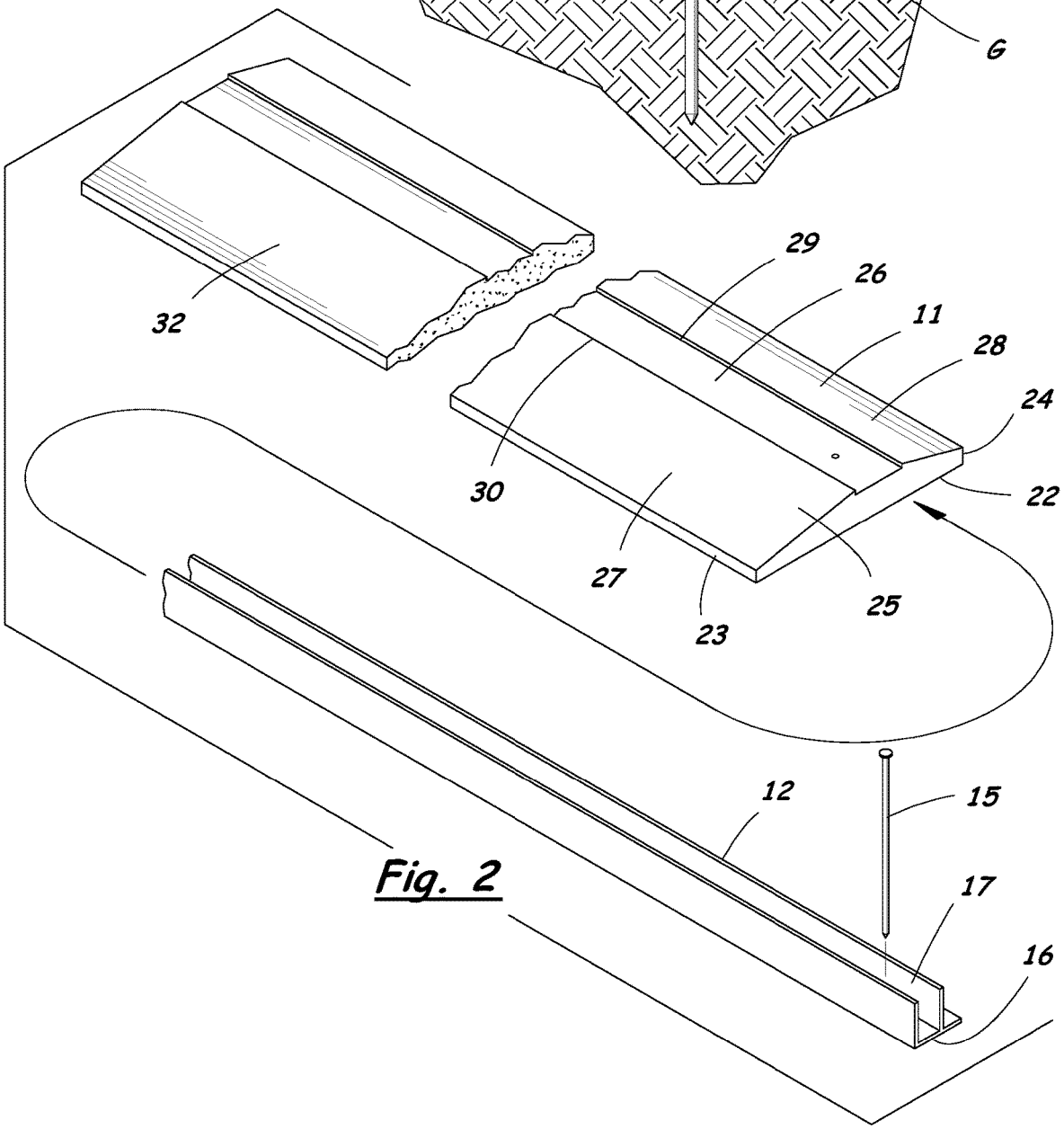
Fig. 2

MODULAR HOME SKIRTING SYSTEM WITH GROUND COVER STRIPS

RELATED APPLICATIONS

This application claims the benefit of U.S. Provisional Patent Application No. 62/812,956 filed on Mar. 1, 2019. The entire content of the provisional application is incorporated herein by reference.

BACKGROUND OF THE INVENTION

Field of the Invention

The present invention relates generally to modular home skirting systems, and in particular, to skirting systems that can be placed around modular homes to close the space between the bottom of the home and the ground surface.

Description of the Related Art

Modular home skirting systems are commonly used to cover the space between the bottom of the modular home and the ground surface to improve the look and curb appeal of the home. Conventional skirting systems include bottom rail members attached to the ground by spikes, top rail members attached to the side of the house, and skirting panels that extend between the top and bottom rail members. The skirting panels are held in place by inserting the top of the skirting panels into a downwardly facing channel of the top rail members, and by inserting the bottom of the skirting panels into an upwardly facing channel of the bottom rail members. The bottom rail members are typically J-channel members or similar trim pieces that do little to suppress vegetation surround the skirting system.

There is a need for an improved skirting system that includes a ground cover feature to prevent vegetation from growing close to the skirting system and to protect the skirting system from grounds maintenance operations.

SUMMARY OF THE INVENTION

An object of the present invention is to provide an improved skirting system for modular homes that prevents vegetation from growing close to the skirting panels and protects the skirting panels from grounds maintenance machinery.

A further object of the present invention is to provide a skirting system that is easy to install to a modular home, that can be used with uneven ground surfaces, that is inexpensive to manufacture, that is effective to suppress vegetation and protect from mower and string trimmer damage, and that is capable of a long useful life.

These and other objects of the present invention are provided by a modular home skirting system that has a ground cover strip to provide ground cover for protecting the skirting system during grounds maintenance and for suppressing vegetation close to the skirting panels. The ground cover strip includes flexible straight and corner pieces laid end-to-end on the ground surface around a perimeter of the modular home. The ground cover strip has a bottom, an outer edge, an inner edge, and a top between the outer and inner edges. The top has an open channel formed therein which faces upwardly and receives a base of a ground channel member. The top also has an outer portion that slopes downwardly from the open channel to the outer edge. Anchoring spikes are driven through the base of the ground channel member and the ground cover strip and into the ground to anchor the ground cover strip and the ground channel member to the ground.

According to one aspect of the present invention, a modular home skirting system is provided, comprising: a plurality of skirting panels adapted to close an open space between a lower edge of a modular home and a ground surface; a ground channel member having a base and a first open channel facing upwardly for receiving a lower end of the skirting panels; and a ground cover strip placed between the ground channel member and the ground surface. The ground cover strip has a bottom for contacting the ground surface, an outer edge, an inner edge, and a top between the outer and inner edges. The top has a second open channel facing upwardly for receiving the base of the ground channel member, an outer portion that slopes downwardly from the second open channel to the outer edge, and an inner portion that slopes downwardly from the second open channel to the inner edge. The ground cover strip provides ground cover to prevent vegetation from growing close to the skirting panels and for protecting the skirting panels from grounds maintenance machinery According to another aspect of the present invention, a modular home skirting system is provided, comprising: a plurality of skirting panels arranged to close a space between a lower edge of a modular home and a ground surface; a plurality of ground channel members each having a base and a first open channel facing upwardly for receiving a lower end of the skirting panels; and a plurality of ground cover strips comprising flexible rubber material laid end-to-end on the ground surface around a perimeter of the modular home. The ground cover strips have a bottom for contacting the ground surface, an outer edge, an inner edge, and a top between the outer and inner edges. The top has a second open channel formed therein which faces upwardly and receives the base of the ground channel member therein. The top has an outer portion that slopes downwardly from the second open channel to the outer edge, and an inner portion that slopes downwardly from the second open channel to the inner edge. The ground cover strips are flexible to conform to undulations in the ground surface. The ground cover strips provide ground cover for preventing vegetation from growing close to the skirting panels and for protecting the skirting panels from grounds maintenance machinery.

According to another aspect of the present invention, a ground cover strip is provided for a modular home skirting system. The ground cover strip comprises: a length of flexible rubber material having a bottom for contacting a ground surface, an outer edge, an inner edge, and a top between the outer and inner edges; the top comprising an open channel formed therein which faces upwardly for receiving a lower part of the modular home skirting system; and the top further comprising an outer portion that slopes downwardly from the open channel to the outer edge, and an inner portion that slopes downwardly from the open channel to the inner edge. The ground cover strip is flexible to conform to undulations in the ground surface, and the ground cover strip provides ground cover for preventing vegetation from growing close to the modular home skirting system and for protecting the skirting system from grounds maintenance machinery.

Numerous other objects of the present invention will be apparent to those skilled in this art from the following description wherein there is shown and described embodiments of the present invention, simply by way of illustration of some of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the present invention is made with reference to the accompanying drawings. In the drawings:

FIG. 1 is a cross section view of a lower portion of a modular home skirting system anchored to the ground.

FIG. 2 is an exploded perspective view of the lower portion of the modular home skirting system shown in FIG. 1.

DETAILED DESCRIPTION OF THE INVENTION

Figure 3:
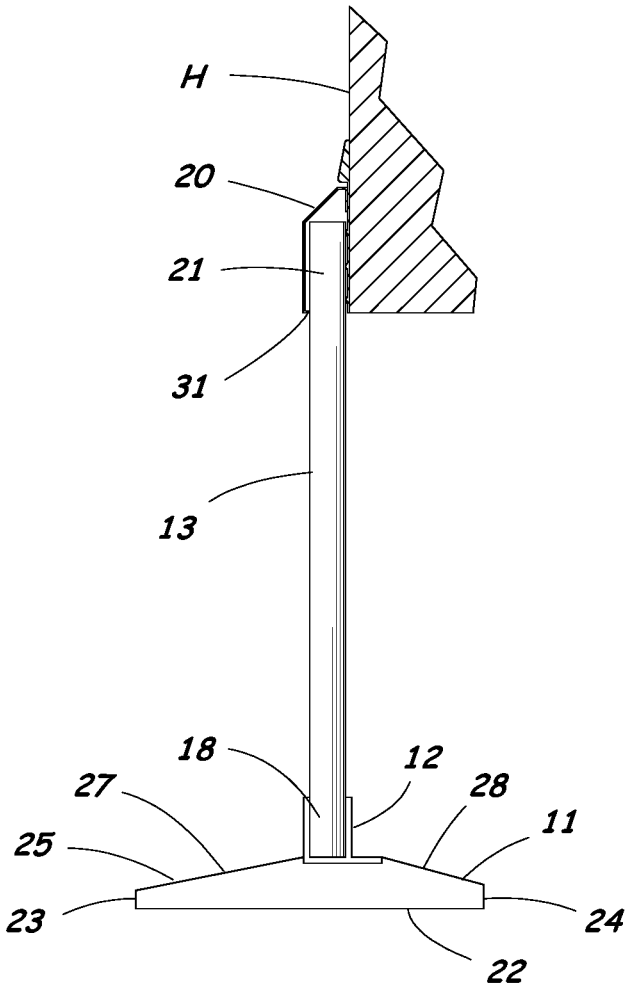
FIG. 3 is a cross section view of the modular home skirting system attached to an outer wall of a modular home.
Figure 4:
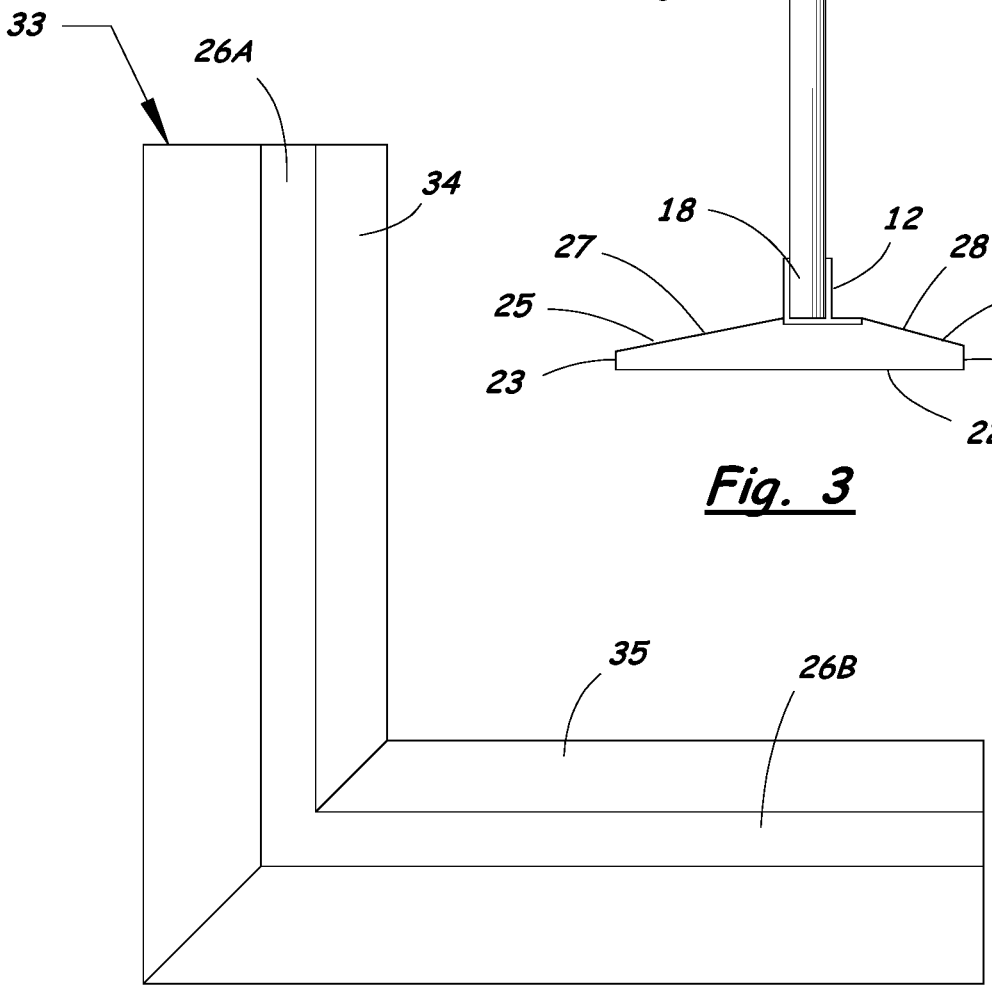
FIG. 4 is a corner section of the ground cover strip of the present invention.
Figure 5:
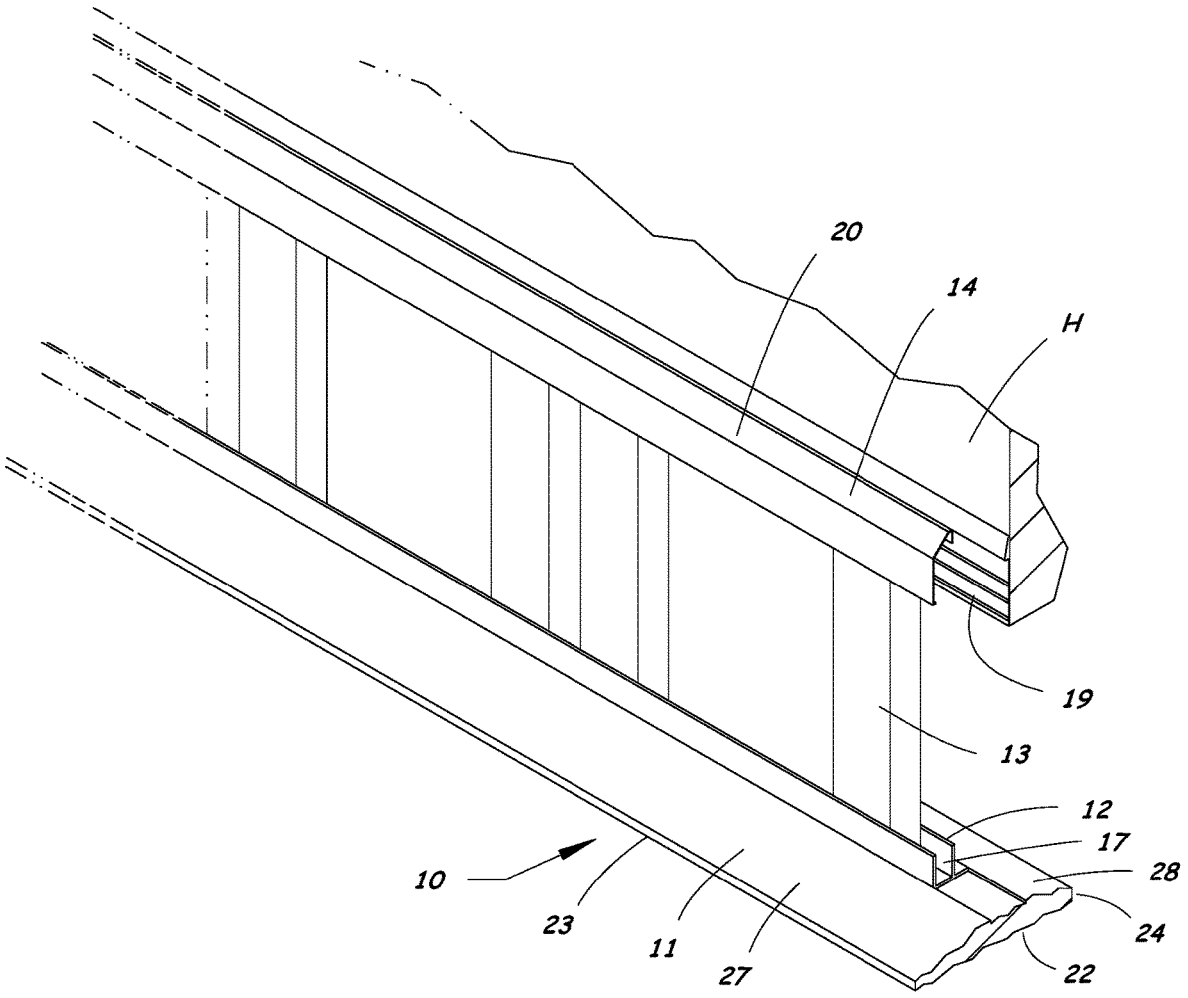
FIG. 5 is a perspective view of the modular home skirting system of the present invention.
Figure 6:
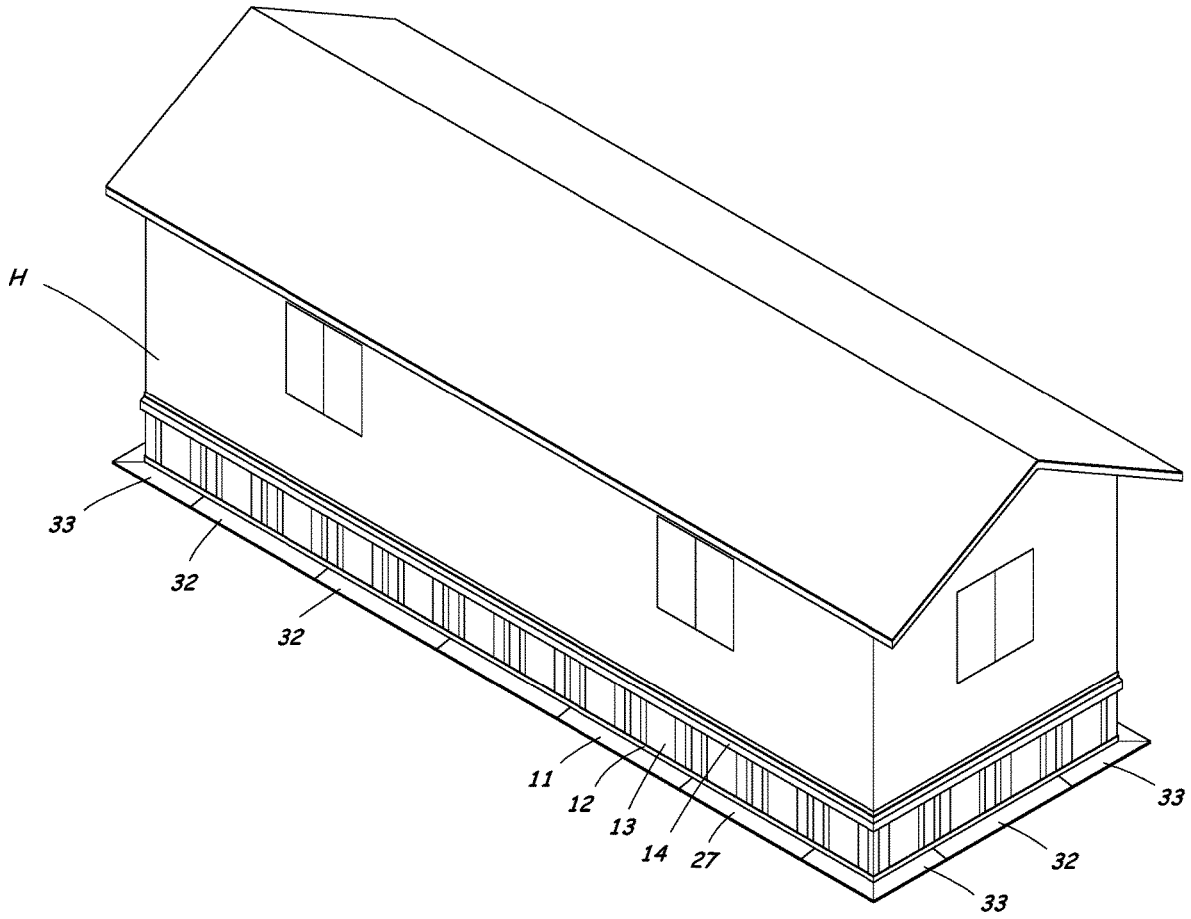
FIG. 6 is a perspective view of the skirting system of the present invention installed around the perimeter of a modular home.

A modular home skirting system 10 with ground cover strips 11 according to the present invention will now be described in detail with reference to FIGS. 1 to 6 of the accompanying drawings.

The skirting system 10 includes ground cover strips 11, ground channel members 12, skirting panels 13, and top rail trim members 14. The ground channel members 12 and ground cover strips 11 are anchored to the ground G by spikes 15, and the top rail trim members 14 are secured to the side of the modular home H by screws or other suitable fasteners. The skirting panels 13 extend between the top rail trim members 14 and the ground channel members 12 to close a space between the bottom B of the modular home H and the ground surface GS.

The skirting panels 13 can be provided in predetermined widths (e.g., 12" to 48") and configurations that interlock together. The skirting panels 13 can be made of any suitable material, such as vinyl, and can have a variety of decorative designs and colors to give the modular home H an attractive appearance.

The ground channel members 12 can be J-channel members or other conventional bottom rail trim members for skirting systems. The ground channel members 12 have a base 16 and a first open channel 17 facing upwardly for receiving a lower end 18 of the skirting panels 13.

The top rail trim members 14 can be a 2-piece cap trim assembly with a first piece 19 secured to the outer wall of the home H and the second piece 20 snapped into an interlocking relationship with the first piece 19 to cover the upper end 21 of the skirting panels 13. The top rail trim members 14 can also be J-channel members that have an open channel facing downwardly to receive the upper end 21 of the skirting panels 13. A portion of the top rail trim members 14 extends over the upper end 21 of the skirting panels 13 to hold the upper ends 21 of the skirting panels 13 to the side of the modular home H.

The ground cover strips 11 are placed on the ground surface GS below the ground channel members 12. The ground cover strips 11 have a bottom surface 22 for contacting the ground surface GS, an outer edge 23, an inner edge 24, and a top 25 between the outer and inner edges 23, 24. The top 25 of the ground channel members 11 has a second open channel 26 facing upwardly for receiving the base 16 of the ground channel member 12. The ground cover strips 11 provide ground cover to prevent vegetation from growing close to the skirting panels 13 and for protecting the skirting panels 13 from grounds maintenance machinery.

An outer portion 27 of the top 25 of the ground cover strips 11 slopes downwardly from the second open channel 26 to the outer edge 23. An inner portion 28 of the top 25 of the ground cover strips 11 slopes downwardly from the second open channel 26 to the inner edge 24. The second open channel 26 is located closer to the inner edge 24 of the ground cover strip 11 than to the outer edge 23. For example, the distance between the inner edge 29 of the second open channel 26 and the inner edge 24 of the ground cover strip 11 can be approximately 50 to 75% of the distance between the outer edge 30 of the second open channel 26 and the outer edge 23 of the ground cover strip 11. The inner portion 28 of the ground cover strip 11 has a steeper slope than the outer portion 27.

The ground cover strip 11 can have a length of approximately 5 to 20 feet and a width of approximately 6 to 10 inches. In one exemplary embodiment, the ground cover strip 11 has a length of approximately 12 feet and a width of approximately 7.25 inches. The length of the ground cover strip 11 can be cut as needed during installation to fit the dimensions of the modular home H.

The second open channel 26 of the ground cover strip 11 in the exemplary embodiment has a width of approximately 1.4 inches, which accommodates the width of the base 16 of the ground channel member 12 that fits within the second open channel 26. The distance between the inner edge 29 of the second open channel 26 and the inner edge 24 of the ground cover strip 11 is approximately 2.1 inches, and the distance between the outer edge 30 of the second open channel 26 and the outer edge 23 of the ground cover strip 11 is approximately 3.5 inches. The height of the ground cover strip 11 is approximately 0.4 inch at its outer edge 23, approximately 0.5 inch at its inner edge 24, and approximately 1.3 inches at its thickest point adjacent to the second open channel 26.

The ground cover strips 11 are made of a mix of crumb rubber and an adhesive, such as urethane. The crumb rubber can be obtained from conventional automotive tire recycling processes, thereby making the ground cover strips 11 environmentally friendly, durable and long lasting. A compression molding process can be used to form the ground cover strips 11 using a mold with the desired shape of the ground cover strips 11. The process of making the ground cover strips 11 includes placing the mixture of crumb rubber and adhesive into the mold and compressing the mixture until the materials set up or the adhesive cures. Heat can be added to the process, as needed, to cure, fuse or form the materials into the desired shape.

The ground cover strips 11 are made of flexible material, such as rubber, and are thereby flexible to conform to undulations and uneven terrain on the ground surface GS surrounding the perimeter of the modular home H.

The skirting system 10 can be installed to the modular home H by placing the ground cover strips 11 on the ground surface GS around the perimeter of the home H, and placing the base 16 of the ground channel members 12 in the second open channel 26 of the ground cover strips 11. Spikes 15 are then driven through the base 16 of the ground channel members 12 and the ground cover strips 11 at spaced locations around the perimeter of the modular home H to anchor the ground channel members 12 and ground cover strips 11 to the ground G. The bottom 18 of the skirting panels 13 are then inserted in the first open channel 17 of the ground channel members 12. The top 21 of the skirting panels 13 are inserted into the downwardly facing channel 31 of the top rail trim members 14, or the top rail trim members 14 are assembled over the top 21 of the skirting panels 13.

The skirting system 10 includes a plurality of ground cover strips 11 placed end-to-end around the perimeter of the modular home H. The ground cover strips 11 include straight members 32 that extend along straight portions of the modular home H, and L-shaped corner members 33 (FIG. 4) for use around corners of the modular home H. The straight members 32 each have a linear second open channel 26 for use along the straight portions of the modular home H. The L-shaped corner members 33 each have first and second sections 34, 35 that are perpendicular to each other for use around corners of the modular home H. The first and second sections 34, 35 have first and second channel portions 26A, 26B, respectively, that intersect and are perpendicular to each other.

While the invention has been described in connection with specific embodiments thereof, it is to be understood that this is by way of illustration and not of limitation, and the scope of the appended claims should be construed as broadly as the prior art will permit.

What is claimed is:

1. A modular home skirting system, comprising:

a plurality of skirting panels adapted to close an open space between a lower edge of a modular home and a ground surface;

a ground channel member having a base and a first open channel facing upwardly for receiving a lower end of said skirting panels; and a ground cover strip placed between the ground channel member and the ground surface, said ground cover strip comprises a flexible material and is flexible to conform to unevenness in the ground surface, said ground cover strip having a bottom for contacting the ground surface, an outer edge, an inner edge, and a top between said outer and inner edges, said top having a second open channel facing upwardly for receiving the base of the ground channel member, an outer portion that slopes downwardly from said second open channel to said outer edge, and an inner portion that slopes downwardly from said second open channel to said inner edge, whereby said ground cover strip provides ground cover to prevent vegetation from growing close to the skirting panels and for protecting the skirting panels from grounds maintenance machinery;

wherein said second open channel is located closer to said inner edge of said ground cover strip than to said outer edge.

2. A modular home skirting system, comprising:

a plurality of skirting panels adapted to close an open space between a lower edge of a modular home and a ground surface;

a ground channel member having a base and a first open channel facing upwardly for receiving a lower end of said skirting panels; and a ground cover strip placed between the ground channel member and the ground surface, said ground cover strip comprises a flexible material and is flexible to conform to unevenness in the ground surface, said ground cover strip having a bottom for contacting the ground surface, an outer edge, an inner edge, and a top between said outer and inner edges, said top having a second open channel facing upwardly for receiving the base of the ground channel member, an outer portion that slopes downwardly from said second open channel to said outer edge, and an inner portion that slopes downwardly from said second open channel to said inner edge, whereby said ground cover strip provides ground cover to prevent vegetation from growing close to the skirting panels and for protecting the skirting panels from grounds maintenance machinery;

further comprising an anchoring spike driven through the base of the ground channel member and the ground cover strip and into the ground surface to anchor the ground cover strip to the ground surface.

3. The modular home skirting system according to claim 1, further comprising a top rail trim member attached to an outer side of said modular home, said top rail trim member extending over an upper end of said skirting panels.

4. The modular home skirting system according to claim 1, wherein said inner portion of the top of said ground cover strip has a steeper slope than said outer portion.

5. The modular home skirting system according to claim 1, wherein said ground cover strip is made with a compression molding process.

6. The modular home skirting system according to claim 1, wherein said ground cover strip comprises crumb rubber.

7. The modular home skirting system according to claim 1, wherein said ground cover strip comprises a mix of crumb rubber and an adhesive.

8. The modular home skirting system according to claim 7, wherein said adhesive comprises urethane.

9. The modular home skirting system according to claim 1, wherein said ground cover strip comprises a plurality of ground cover strips placed end-to-end around the perimeter of the modular home, with each of said ground cover strips comprising said second open channel facing upwardly for receiving the ground channel member of the skirting system.

10. The modular home skirting system according to claim 9, wherein said anchoring spike comprises a plurality of anchoring spikes driven through the base of the ground channel member and the ground cover strip and into the ground surface at spaced locations around the perimeter of the modular home.

11. The modular home skirting system according to claim 9, wherein at least one of said plurality of ground cover strips is a straight member in which said second open channel is linear for use along a straight portion of the modular home.

12. The modular home skirting system according to claim 11, wherein at least one of said plurality of ground cover strips is an L-shaped corner member having first and second sections that are perpendicular to each other for use around corners of the modular home, said first and second sections having first and second channel portions, respectively, that intersect and are perpendicular to each other.

13. A modular home skirting system, comprising:

a plurality of skirting panels arranged to close a space between a lower edge of a modular home and a ground surface;

a plurality of ground channel members each having a base and a first open channel facing upwardly for receiving a lower end of said skirting panels; and a plurality of ground cover strips comprising flexible rubber material laid end-to-end on the ground surface around a perimeter of the modular home, said ground cover strips having a bottom for contacting the ground surface, an outer edge, an inner edge, and a top between said outer and inner edges, said top having a second open channel formed therein which faces upwardly and receives the base of the ground channel member therein, said top having an outer portion that slopes downwardly from said second open channel to said outer edge, and an inner portion that slopes downwardly from said second open channel to said inner edge, said ground cover strips being flexible to conform to undulations in the ground surface, whereby said ground cover strips provide ground cover for preventing vegetation from growing close to the skirting panels and for protecting the skirting panels from grounds maintenance machinery, wherein said second open channel is located closer to said inner edge of said ground cover strip than to said outer edge, and wherein said inner portion of the top of said ground cover strip has a steeper slope than said outer portion of said ground cover strip.

14. The modular home skirting system according to claim 13, wherein said ground cover strip comprises a mix of recycled crumb rubber and an adhesive.

15. The modular home skirting system according to claim 13, wherein said plurality of ground cover strips comprises a plurality of straight pieces in which said second open channel is linear for use along a straight portion of the modular home, and a plurality of L-shaped corner pieces in which said second open channel has a corner that corresponds to corners of the modular home.

16. The modular home skirting system according to claim 15, further comprising a plurality of anchoring spikes driven through the base of the ground channel members and the ground cover strips and into the ground surface at spaced locations around the perimeter of the modular home to anchor the ground cover strips and the ground channel members to the ground surface.

* * * * *